US006073909A

United States Patent [19]

Danielson et al.

[11] Patent Number: 6,073,909

[45] Date of Patent: Jun. 13, 2000

[54] FILLING CONNECTOR FOR GAS CONTAINERS

[75] Inventors: Robert B. Danielson, Mahtomedi; Stanlee W. Meisinger, Golden Valley, both of Minn.

[73] Assignee: Fastest, Inc., St. Paul, Minn.

[21] Appl. No.: 09/021,291

[22] Filed: Feb. 10, 1998

[51] Int. Cl.[7] ..... B65D 1/04

[52] U.S. Cl. ..... 251/148; 141/312; 141/383

[58] Field of Search ..... 251/148; 141/383, 141/312; 285/178

[56] References Cited

U.S. PATENT DOCUMENTS

| | | | |
|---|---|---|---|
| 1,784,821 | 12/1930 | Crowley . | |
| 1,832,639 | 11/1931 | Kneeland . | |
| 1,936,868 | 11/1933 | Whitney . | |
| 4,614,348 | 9/1986 | Fournier | 277/205 |
| 5,131,625 | 7/1992 | Hacker et al. | 251/149.6 |
| 5,312,084 | 5/1994 | Weh | 251/148 |
| 5,582,223 | 12/1996 | Weh et al. | 141/383 |
| 5,775,668 | 7/1998 | Howser | 251/148 |

FOREIGN PATENT DOCUMENTS 296 19 912 U
1 2/1998 Germany .

*Primary Examiner*—A. Michael Chambers
*Attorney, Agent, or Firm*—Merchant & Gould P.C.

[57] ABSTRACT

A filling connector for fastening to a valve arrangement on a gas container to enable filling of the gas container with a gas. The filling connector includes a housing defining a longitudinal axis, with a recess formed through a side of the housing to receive the valve arrangement of the gas container. A bore is formed in the housing parallel to the longitudinal axis, with the bore extending from one end of the housing and opening into the recess. A shaft portion is fixed to the housing in the bore, and an outer surface of the shaft portion is spaced from an interior surface of the housing which forms the bore to define a space between the outer surface and the interior surface. A piston is slideably disposed within the bore, with the piston including a sealing neck extending into the recess and a skirt portion disposed within the space and slideable on the outer surface of the shaft portion. A biasing spring is interengaged between the piston and the housing so as to bias the piston in a direction away from the recess. The biasing spring is disposed around the outside of the piston whereby the biasing spring is not wetted by the gas flowing through the filling connector.

14 Claims, 3 Drawing Sheets

FILLING CONNECTOR FOR GAS CONTAINERS

FIELD OF THE INVENTION

The present invention relates to a filling connector which fastens to a valve arrangement of a gas container for introducing a gaseous fluid, such as oxygen, carbon dioxide and the like, into the container. The filling connector can also be used to remove gaseous fluid from the container.

BACKGROUND OF THE INVENTION

Gas containers, such as gas bottles, are common in a wide variety of industries. For instance, in the medical industry, gas containers are typically filled with oxygen, carbon dioxide and the like, for a variety of medical uses. The gas containers are provided with a standardized valve arrangement generally at the top thereof to allow discharge of the gas from the container during use, as well as to permit filling of the container with additional gas. The valve arrangements for the gas containers are standardized to allow a filling apparatus to mate with each valve arrangement. The filling apparatus is generally constructed so as to fasten onto the valve arrangement and allow a gas to be introduced into the container through the filling apparatus and valve arrangement after a valve on the valve arrangement is manually opened, thereby enabling filling of the container.

SUMMARY OF THE INVENTION

The present invention provides an improved filling connector for fastening onto a valve arrangement on a gas container to enable filling of the gas container. The filling connector is designed to permit easy connection and disconnection of the connector and the valve arrangement, as well as facilitating smooth flow through the filling connector.

A preferred embodiment of the filling connector in accordance with the principles of the present invention includes a housing defining a longitudinal axis, with a recess formed through a side of the housing to receive the valve arrangement of the gas container therein. A bore is formed in the housing parallel to the longitudinal axis, with the bore extending from one end of the housing and opening into the recess. A shaft portion is fixed to the housing within the bore, and an outer surface of the shaft portion is spaced from an interior surface of the housing which forms the bore thereby defining a space between the outer surface and the interior surface. A piston is slideably disposed within the bore, with the piston including a sealing neck extending into the recess and a skirt portion disposed within the space and slideable on the outer surface of the shaft portion. A biasing spring is interengaged between the piston and the housing so as to bias the piston in a direction away from the recess. The biasing spring is disposed around the outside of the piston so that the biasing spring is not wetted by the gas flowing through the filling connector.

The inclusion of the biasing spring ensures that when an actuating member of the filling connector is moved to the disconnected position and the flow of gas through the connector is discontinued and the pressure on the piston is released, the piston will be biased so as to disengage from the valve arrangement, thereby facilitating removal of the filling connector from the valve arrangement. Further, since the biasing spring is not wetted by the gas, smooth gas flow is achieved through the filling connector, as well as preventing contamination of the gas. Additionally, by forming the recess through the side of the housing, the filling connector can be easily inserted onto the valve arrangement through a simple sideways movement of the filling connector.

These and various other advantages and features of novelty which characterize the invention are pointed out with particularity in the claims annexed hereto and forming a part hereof. However, for a better understanding of the invention, its advantages and objects attained by its use, reference should be made to the drawings which form a further part hereof, and to the accompanying description, in which there is described a preferred embodiment of the invention.

DETAILED DESCRIPTION OF THE PREFERRED EMBODIMENT

Figure 1:
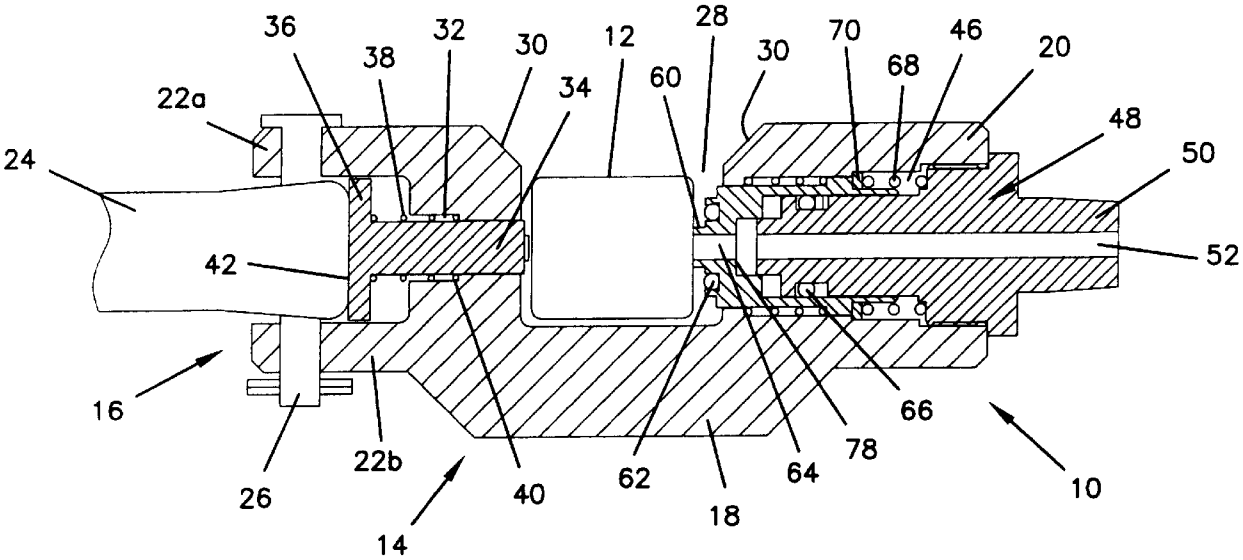
FIG. 1 is a longitudinal cross-sectional top view of the filling connector in accordance with the present invention, with the filling connector disposed around a valve arrangement in a filly open or disengaged position.

With reference now to FIGS. 1–4, a filling connector 10 in accordance with the principles of the present invention is illustrated. The connector 10 is designed for engagement with a valve arrangement 12 disposed on a gas container (not shown), in order to permit filling of the gas container with a gaseous fluid, such as oxygen, carbon dioxide and the like. The filling connector 10 can also be used to enable emptying of the gas container as well. The valve arrangement 12 is generally conventional in design, including a valve structure thereon which is manually operated to control the flow of gas into and from the gas container. No further description of the valve arrangement 12 is provided herein, as the details of such valve arrangements are well known to those having ordinary skill in the art.

The filling connector 10 includes an elongated housing 14 having a bifurcated end 16, a central section 18 and a fitting end 20. A pair of spaced arms 22*a*,22*b* extend from the central section 18 to thereby define the bifurcated end 16, and an actuating lever 24 is pivotally mounted between the arms 22*a,b* on a pivot pin 26 extending between the arms. A recess 28 is formed through one side of the housing 14 at the central section 18, with the recess 28 being sized so as to receive the valve arrangement 12 therein.

As shown in FIG. 1, the recess 28 is oversized relative to the size of the valve arrangement 12, in order to allow the valve arrangement to be shifted within the recess 28 in a direction parallel to a longitudinal axis of the housing 14. Angled walls 30 are preferably provided between the side of the housing and the walls forming the recess 28 in order to guide the valve arrangement 12 into the recess. Since the recess 28 is formed through the side of the housing 14, the valve arrangement 12 can be fitted within the recess 28 through a simple sideways movement of the filling connector 10, with the angled walls 30 guiding the valve arrangement 12 into the recess.

Figure 2:
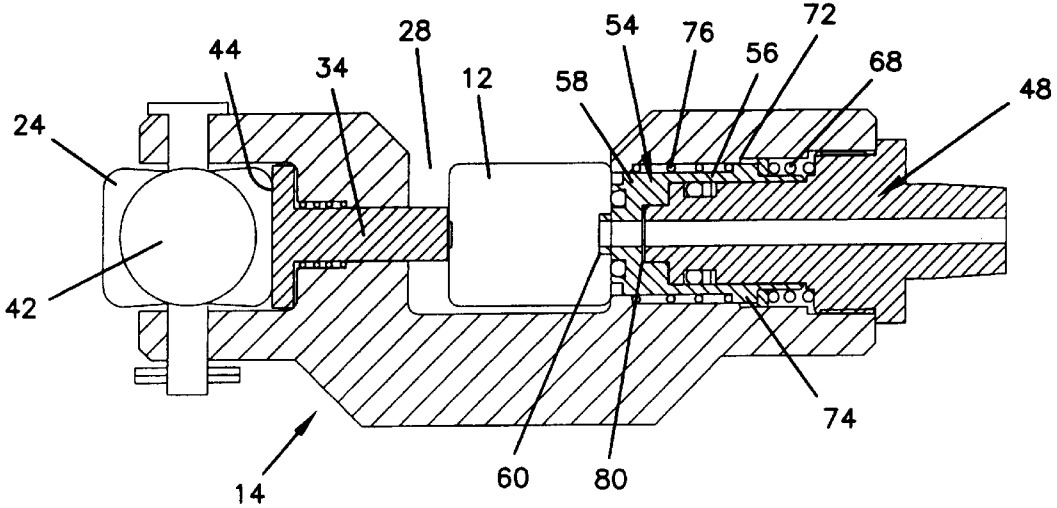
FIG. 2 is a cross-sectional view similar to FIG. 1, but with the filling connector in a connected position.

A passage 32 extends between the recess 28 and the area between the arms 22*a,b*, and an actuating pin 34 is slideably disposed within the passage 32. The actuating pin 34 includes an enlarged end 36 that is engaged with the actuating lever 24, and the opposite end of the actuating pin is engaged with the valve arrangement 12. A coil spring 38, engaged between the enlarged end 36 and a shoulder 40 formed in the passage 32, biases the enlarged end 36 into continuous engagement with the actuating lever 24. The actuating lever 24 includes a first surface 42 that is engaged with the enlarged end 36 in the open position of the filling connector 10 (as shown in FIG. 1), and a second surface 44 that is engaged with the enlarged end 36 in the connected position (as shown in FIG. 2). As the actuating lever 24 is rotated about the pin 26, the surface 44 is brought into contact with the enlarged end 36 of the actuating pin 34, thereby forcing the pin 34 to the right. Since the actuating pin is engaged with the valve arrangement 12, the valve arrangement is forced to the right, toward the fitting end 20, by the actuating pin. Rotation of the actuating lever 24 back in the opposite direction brings the surface 42 back into contact with the enlarged end 36, which allows the actuating pin to move to the left, back to the open or disconnected position.

A bore 46 extends completely through the fitting end 20 of the housing 14, with the bore extending parallel to the longitudinal axis of the housing. A shaft portion 48 is screwed into the fitting end 20 within the bore 46, with a space being defined between the outer surface of the shaft portion 48 and the surface defining the bore 46. The shaft portion 48 includes an end 50 that is suitably adapted for engagement with a high pressure fluid supply line and/or discharge line, with a central fluid passageway 52 extending through the shaft portion 48 allowing fluid to flow through the shaft portion.

A cylindrical piston 54 is slideably disposed within the bore 46 and extends into the recess 28 for sealing engagement with the valve arrangement 12. The piston 54 includes a skirt portion 56 extending from a head portion 58, with the skirt portion 56 being slideably engaged on the outer surface of the shaft portion 48 and the interior surface of the housing that defines the bore 46, within the space therebetween. A neck 60 extends from the head portion 58 into the recess 28, with an o-ring seal 62 disposed in the end of the head portion 58 surrounding the neck 60. The neck 60 and o-ring seal 62 permit the piston 54 to sealingly engage with the valve arrangement 12, as shown in FIG. 2, such that gas leaks are prevented. A central fluid passageway 64 extends through the head portion 58 parallel to the passageway 52, with an o-ring seal 66 disposed in a circumferential channel in the outer surface of the shaft portion 48 preventing fluid leakage between the skirt portion 56 and the shaft portion.

In order to bias the piston 54 toward the valve arrangement 12, a coil spring 68 is disposed within the space between the shaft portion and the housing, with one end of the spring engaged with the shaft portion 48 and the other end of the spring engaged with a washer 70 slideably disposed within the space. Movement of the washer 70 is limited by a shoulder 72 formed on the surface defining the bore 46, with the washer engaging against a shoulder 74 formed on the skirt portion 56 to bias the piston 54 to the left until the washer 70 engages the shoulder 72.

A further coil spring 76 surrounds the skirt portion 56 and is engaged between the housing 14 and the shoulder 74 to bias the piston 54 to the right, away from the recess 28 and against the bias of the spring 68. The biasing force of the spring 68 is greater than the biasing force of the spring 76, such that the piston is biased to the initial position shown in FIG. 1. As can be seen in the Figures, since the spring 76 is disposed around the skirt portion 56, the gas flowing through the connector 10 does not come into contact therewith, thereby providing smooth gas flow, as well as preventing contamination build-up by the spring.

The piston 54 further includes an interior pressure surface 78 thereon which is engaged by the gas flowing through the passageway 52 in order to force the piston to the left to enhance the sealing effect between the piston and the valve arrangement 12. As can be seen in FIG. 2, a slight gap 80 exists between the pressure surface 78 and the end of the shaft portion 48 to permit the gas to engage the pressure surface and thereby force the piston to the left.

Figure 3:
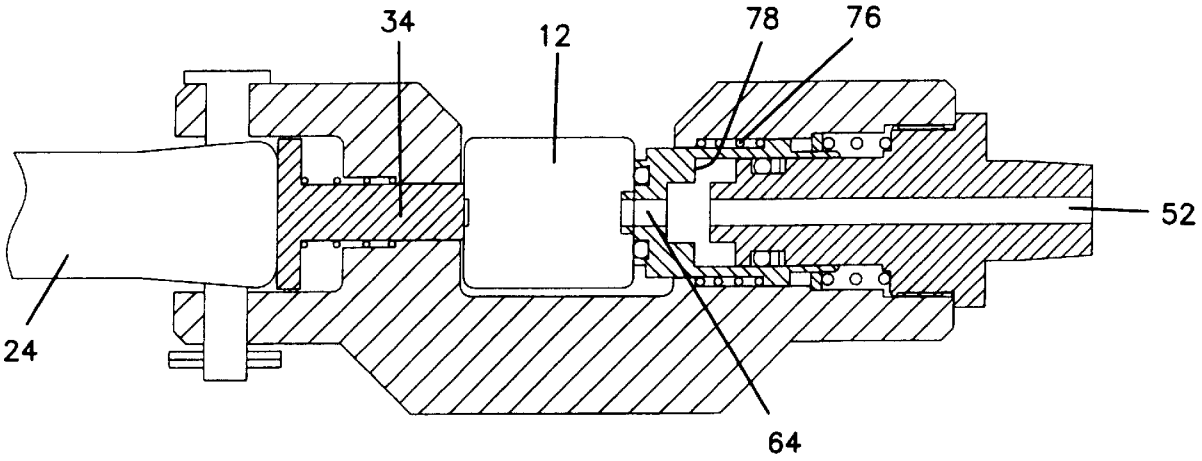
FIG. 3 is a cross-sectional view similar to FIG. 1, but with the filling connector in a disengaged position and under pressure.
Figure 4:
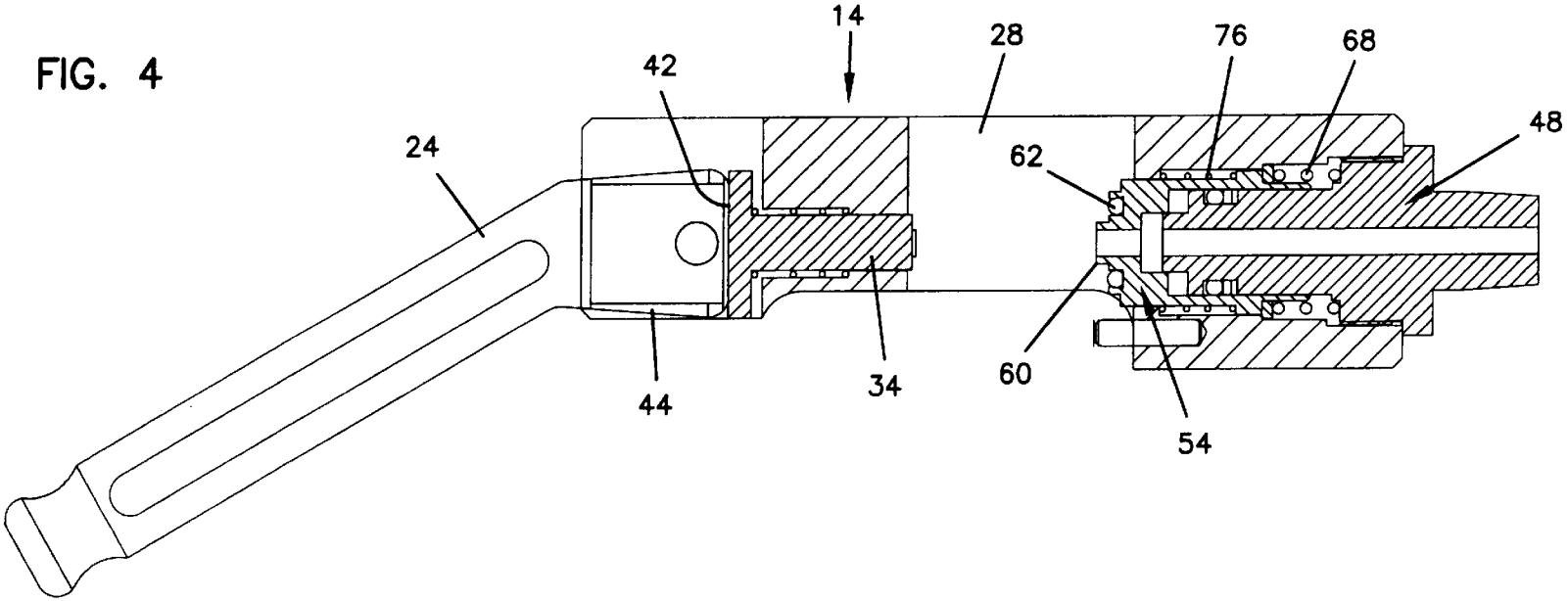
FIG. 4 is a longitudinal cross-sectional side view of the filling connector.

With reference to FIGS. 1–3, the operation of the filling connector 10 will be described. Upon initially disposing the filling connector around the valve arrangement 12, the end of the actuating pin 34 will be disposed adjacent one side of the valve arrangement and the neck 60 will be disposed adjacent the opposite side of the valve arrangement. The actuating lever 24 is then rotated to bring the surface 44 into engagement with the enlarged end 36, thereby forcing the actuating pin 34 to the right which forces the valve arrangement 12 into sealed engagement with the piston 54. The piston 54 is forced to the right, against the bias of the spring 68, to the connected position shown in FIG. 2, leaving the gap 80 between the pressure surface 78 of the piston and the end of the shaft portion 48. The valve on the valve arrangement is then manually opened, thereby permitting gas to flow through the connector 10 and through the valve arrangement, in order to fill the gas container. Due to the gap 80, the piston 54 is forced to the left by the pressure of the gas acting on the surface 78, thereby increasing the sealing effect between the valve arrangement and the piston. Once filling of the gas container is completed, the valve on the valve arrangement is then manually closed, thereby stopping the flow of gas. However, once gas flow is stopped by closing the valve, pressure still remains within the connector which must be released before disconnection can be achieved. This is illustrated in FIG. 3, which shows the actuating lever 24 in the disconnected position, but with the filling connector under pressure such that the piston 54 is forced to the left by the pressure into sealed engagement with the valve arrangement. Release of the pressure can be accomplished in any suitable fashion, such as by a conventional bleed on the fluid supply line, such that upon pressure release, the spring 76 biases the piston to the right, to thereby disengage the piston from the valve arrangement.

Further, if the actuating lever 24 is rotated to the disconnected position while gas is flowing through the filling connector (i.e. while the valve on the valve arrangement is open), the force of the gas acting on the pressure surface 78 will force to the piston to the left, against the biasing force of the spring 76, to thereby maintain the sealed engagement between the valve arrangement and the piston, as can be seen in FIG. 3. Thus, accidental discharge of gas is prevented by maintaining the seal between the valve arrangement and the piston until the gas flow through the filling connector is stopped. Once gas flow is stopped by closing the valve, and pressure is released, the spring 76 can then bias the piston to the position shown in FIG. 1, thereby disengaging the piston from the valve arrangement.

Figure 5:
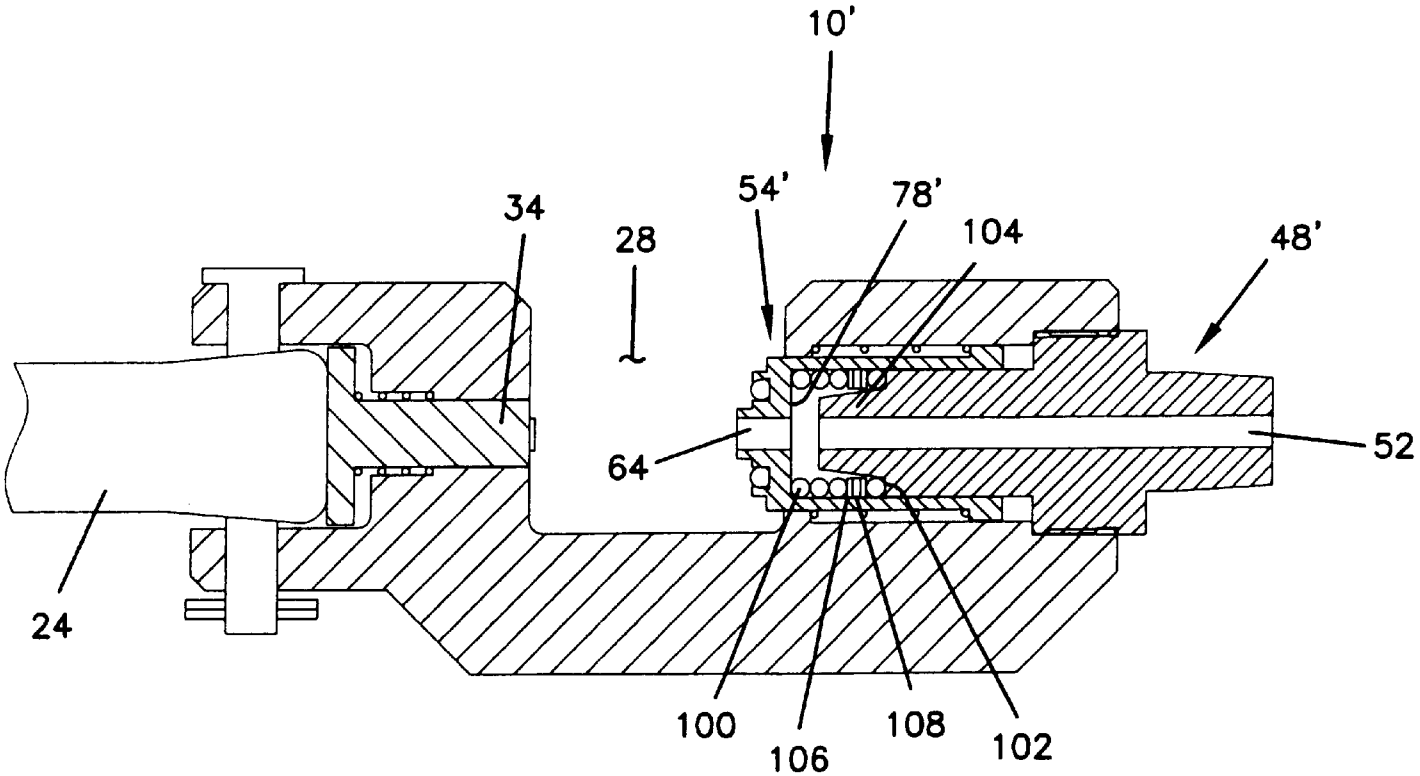
FIG. 5 is a top view of another filling connector of the present invention.

An alternative filling connector 10' is illustrated in FIG. 5, in which elements corresponding to the elements shown in FIGS. 1–4 are referenced by the same reference numerals with a prime designation. The filling connector 10' is similar to the filling connector 10, however instead of the biasing spring 68, a plurality of resilient o-rings 100 are disposed between the pressure surface 78' of the piston and a shoulder 102 defined on the shaft portion 48'. The end of the shaft portion 48' to the left of the shoulder 102 is tapered to define a frustum-shaped end 104, with the o-rings 100 being disposed around the end 104 between the shoulder 102 and the pressure surface 78'. The o-rings 100 are resilient such that when the piston 54' is moved to the right from the position shown in FIG. 5, the o-rings 100 compress to thereby create a biasing force to bias the piston back to the left.

A radial washer 106 having a plurality of radially extending, circumferentially spaced holes 108 is disposed between a pair of the o-rings 100. The radial holes 108 transfer the pressure of the gas to the outside of the o-rings 100, thereby increasing the area of the pressure surface 78' that is acted upon by the gas, thus increasing the pressure force acting on the piston to improve the sealing between the valve arrangement and the piston. The filling connector 10' is otherwise the same as the filling connector 10, including the biasing spring 76' which biases the piston to the right to facilitate disengagement of the valve arrangement from the piston.

It is to be understood that while certain embodiments of the present invention have been illustrated and described, the invention is not limited to the specific forms or arrangements of the parts described and shown, the invention instead residing in the claims hereinafter appended.

We claim:

1. A filling connector for a valve arrangement, comprising:

a housing defining a longitudinal axis, and a recess formed in said housing intersecting said longitudinal axis, said recess adapted to receive the valve arrangement;

a bore formed in said housing parallel to said longitudinal axis, said bore extending from an end of the housing and opening into said recess;

a shaft portion fixed to said housing within the bore;

a piston slideably disposed within the bore and engageable with the valve arrangement; and means for biasing the piston in a direction away from the recess.

2. The filling connector according to claim 1, wherein said piston is slideably disposed on an outer surface of said shaft portion, and said means for biasing is disposed around said piston.

3. A filling connector for introducing fluid into a fluid container having a valve arrangement, comprising:

a housing defining a longitudinal axis, and a recess formed in said housing intersecting said longitudinal axis, said recess adapted to receive the valve arrangement;

a bore formed in said housing parallel to said longitudinal axis, said bore extending from an end of the housing and opening into said recess;

a shaft portion fixed to said housing within the bore, an outer surface of said shaft portion being spaced from an interior surface of the housing which forms the bore to thereby define a space between the outer surface and the interior surface;

a piston slideably disposed within the bore, said piston including a sealing neck extending into said recess, and said piston further including a skirt portion disposed within said space and slideable on the outer surface of the shaft portion; and means for biasing the piston in a direction away from the recess, said means for biasing not being wetted by the fluid.

4. The filling connector according to claim 3, wherein said means for biasing comprises a spring.

5. A filling connector for a valve arrangement, comprising:

a housing defining a longitudinal axis, and a recess formed through a side of said housing intersecting said longitudinal axis, said recess adapted to receive the valve arrangement;

a bore formed in said housing parallel to said longitudinal axis, said bore extending from an end of the housing and opening into said recess;

a shaft portion fixed to said housing within the bore, an outer surface of said shaft portion being spaced from an interior surface of the housing which forms the bore to thereby define a space between the outer surface and the interior surface;

a piston slideably disposed within the bore, said piston including a sealing neck extending into said recess, and said piston further including a skirt portion disposed within said space and slideable on the outer surface of the shaft portion; and a biasing spring engaged with the piston and the housing, said biasing spring biasing the piston in a direction away from the recess.

6. The filling connector according to claim 5, further including a shoulder formed on an outer circumference of said skirt portion, said biasing spring being disposed within said bore and surrounding said skirt portion, with one end of said biasing spring contacting the shoulder.

7. The filling connector according to claim 5, wherein the shaft portion and the piston each include a fluid passageway extending parallel to the longitudinal axis to allow a fluid to flow therethrough, and wherein said biasing spring is not wetted by the fluid.

8. The filling connector according to claim 7, further comprising means for biasing the piston in a direction toward the recess.

9. The filling connector according to claim 8, wherein said means for biasing comprises a coil spring interengaged between the shaft portion and a washer disposed within the bore, said washer being engageable with said skirt portion.

10. The filling connector according to claim 9, further comprising a pressure surface on said piston, the fluid contacting the pressure surface to force the piston toward the recess.

11. The filling connector according to claim 8, wherein said means for biasing comprises a plurality of resilient rings disposed between the piston and the shaft portion.

12. The filling connector according to claim 11, wherein said resilient rings are in contact with the fluid.

13. The filling connector according to claim 12, further comprising a pressure surface on said piston, the fluid contacting the pressure surface to force the piston toward the recess.

14. The filling connector according to claim 13, further including a washer disposed between a pair of said resilient rings, said washer including a plurality of radial holes therein to allow the fluid to flow to the outside of the resilient rings.

* * * * *